US007675393B2

(12) United States Patent
Kawakubo et al.

(10) Patent No.: US 7,675,393 B2
(45) Date of Patent: Mar. 9, 2010

(54) MEMS SWITCH

(75) Inventors: Takashi Kawakubo, Yokohama (JP); Toshihiko Nagano, Kawasaki (JP); Michihiko Nishigaki, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 285 days.

(21) Appl. No.: 11/673,984

(22) Filed: Feb. 12, 2007

(65) Prior Publication Data

US 2008/0017489 A1 Jan. 24, 2008

(30) Foreign Application Priority Data

Jul. 24, 2006 (JP) ..... 2006-201064

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 6,046,659 A * 4/2000 Loo et al. ..... 200/181
6,127,908 A * 10/2000 Bozler et al. ..... 333/246
6,191,671 B1 * 2/2001 Schlaak et al. ..... 335/78
6,229,683 B1 * 5/2001 Goodwin-Johansson .... 361/233
6,667,245 B2 * 12/2003 Chow et al. ..... 438/723
6,882,264 B2 * 4/2005 Cunningham ..... 337/139
6,960,971 B2 11/2005 Park et al.
6,962,832 B2 * 11/2005 Chou ..... 438/52
7,343,655 B2 * 3/2008 Mehta ..... 29/25.35
7,382,218 B2 * 6/2008 Charvet ..... 335/78
2005/0190023 A1 9/2005 Nakatani et al.
2005/0194867 A1 9/2005 Kawakubo et al.
2005/0242687 A1 11/2005 Kawakubo et al.
2006/0055287 A1 3/2006 Kawakubo et al.
2006/0067840 A1 3/2006 Kawakubo et al.
2006/0285255 A1 12/2006 Kawakubo et al.

OTHER PUBLICATIONS

Muldavin et al, Inline Capacitive and DC-Contact MEMS Shunt Switches, IEEE Microwave and Wireless Components Letters, vol. 11, No. 8, Aug. 2001.

* cited by examiner

*Primary Examiner*—Anh T. Mai
*Assistant Examiner*—Bernard Rojas
(74) *Attorney, Agent, or Firm*—Turocy & Watson, LLP

(57) ABSTRACT

A MEMS switch according to one aspect of the present invention comprises: a substrate; a fixing portion formed on the substrate; a movable beam including a lower electrode, a first insulation layer formed on the lower electrode, and an upper electrode formed on the first insulation layer, the movable beam having one end fixed by the fixing portion, the lower electrode and the first insulation layer having an opening going through both of the lower electrode and the first insulation layer; a fixed electrode formed on the substrate facing to a bottom surface of the other end of the movable beam, the fixed electrode facing to the opening; a contact electrode formed in the opening so as to project below the bottom surface of the movable beam and to be electrically connected to the upper electrode as well as to be insulated from the lower electrode; and a second insulation layer formed on the fixed electrode and having an opening facing to the contact electrode so as to insulate the lower electrode from the fixed electrode and to permit the contact electrode to come into contact with the fixed electrode.

14 Claims, 6 Drawing Sheets

MEMS SWITCH

CROSS-REFERENCE TO RELATED APPLICATION

This application is based upon and claims the benefit of priority from prior Japanese Patent Application No. 2006-201064 filed on Jul. 24, 2006 in Japan; the entire contents of which are incorporated herein by reference.

BACKGROUND OF THE INVENTION

1. Field of the Invention

The present invention relates to a MEMS (Micro-Electro-Mechanical System) switch that can be applied also as a high frequency circuit switch.

2. Related Background Art

It is desired to apply MEMS, to which a semiconductor process is applied, to various fields. In, for example, a field to which a high frequency circuit is applied, application of MEMS acting as an RF switch is strongly desired.

A MEMS switch applied to high frequency circuit can be used for from direct current (DC) circuit to high frequency circuit and is roughly divided into a DC contact type MEMS switch for supplying power by ohmic contact of two contact points and a capacitive type MEMS switch in which two contact points come into contact with each other through a dielectric film and which can be mainly used only for high frequency of 10 GHz or more.

Since consumer wireless equipment mainly uses a frequency range from about 500 MHz to 5 GHz, the DC contact type MEMS switch in particular has a high value of usage.

An electrostatic drive mechanism is mainly used as a drive mechanism of a conventional DC contact type MEMS switch. This is because a material and a structure are simple and a process is easy.

A typical structure of the MEMS switch is such that a pull-down electrode covered with a dielectric film and an ohmic contact electrode are separately formed in adjacent regions on a substrate as well as a conductive movable beam, which is supported by the base of one side end, is installed so that the other side end thereof is located above the pull-down electrode and the contact electrode. The movable beam has a small spring.

In operation of the MEMS switch, it is opened and closed in such a manner that a voltage is applied between the pull-down electrode and the movable beam, the movable beam is attracted by electrostatic force, and the contact electrode located adjacent to the pull-down electrode is caused to come into ohmic contact with the movable beam.

In the above structure, when an about 10 μm thick movable beam formed by a bulk micro machining method is used, since the movable beam has approximately sufficient rigidity, it is possible to obtain a sufficient amount of press force of the movable beam to the contact electrode.

However, when the movable beam is formed by the bulk micro machining method, a problem arises in that the manufacturing process of the movable beam is made complex and a manufacturing cost becomes expensive.

In contrast, when the movable beam is formed by laminating thin films by a surface micro machining method, manufacturing steps is relatively simple. However, since the thickness of the movable beam is several microns at the maximum and ordinarily 1 to 2 μm and the movable beam is liable to flex due to its small rigidity, it is difficult for the movable beam to apply a sufficient amount of contact pressure to the contact electrode.

Although the bulk micro machining method and the surface micro machining method have advantages and disadvantages, respectively, as described above, it is desirable to employ the surface micro machining method from the view point of suppressing manufacturing cost.

Accordingly, there have been proposed structures for obtaining a sufficient amount of contact pressure force between a contact electrode and a movable beam while employing the surface micro machining method. Refer to, for example, a reference "Inline Capacitive and DC-Contact MEMS Shunt Switches", Jeremy B. Muldavin and Gabriel M. Rebeiz, IEEE MICROWAVE AND WIRELESS COMPONENTS LETTERS, VOL. 11, No. 8, pp. 334-386, AUGUST 2001.

The MEMS switch disclosed in the reference has a structure in which a lattice-like contact electrode is formed on a pull-down electrode, and when a voltage is applied between the pull-down electrode, which is exposed to the opening of the lattice-like contact electrode, and a conductive movable beam, the movable beam is attracted and caused to come into ohmic contact with the lattice-like contact electrode.

In the MEMS switch of the reference, however, since the lattice-like contact electrode is formed on the pull-down electrode, the distance between the pull-down electrode and the movable beam must be set in consideration of the thickness of the contact electrode, and it is almost impossible to adjust the distance. Since the distance between the pull-down electrode and the movable beam is increased by the thickness of the contact electrode, the attraction force between the pull-down electrode and the movable beam is still insufficient, and thus the contact pressure force obtained between the movable beam and the contact electrode cannot be sufficient.

To obtain a larger amount of attraction force between the pull-down electrode and the movable beam, it is necessary to increase the exposed area of the pull-down electrode, that is, to reduce the sizes of the respective portions of the lattice-like contact electrode. However, a problem arises from the arrangement in that the contact resistance between the movable beam and the pull-down electrode is increased.

Further, when it intended to obtain a sufficient amount of attraction force by increasing the voltage applied between the pull-down electrode and the movable beam, another problem arises in that power consumption is increased.

From what has been described above, there is required a MEMS switch having such a structure that even if a movable beam is formed of a deposited thin-film, a sufficient amount of contact pressure force can be obtained between the movable beam and a contact electrode as well as the contact resistance between them can be suppressed small.

SUMMARY OF THE INVENTION

According to one aspect of the present invention, there is provided a MEMS switch comprising: a substrate; a fixing portion formed on the substrate; a movable beam including a lower electrode, a first insulation layer formed on the lower electrode, and an upper electrode formed on the first insulation layer, the movable beam having one end fixed by the fixing portion, the lower electrode and the first insulation layer having an opening going through both of the lower electrode and the first insulation layer; a fixed electrode formed on the substrate facing to a bottom surface of the other end of the movable beam, the fixed electrode facing to the opening; a contact electrode formed in the opening so as to project below the bottom surface of the movable beam and to be electrically connected to the upper electrode as well as to be insulated from the lower electrode; and a second insulation layer formed on the fixed electrode and having an opening facing to the contact electrode so as to insulate the lower electrode from the fixed electrode and to permit the contact electrode to come into contact with the fixed electrode.

According to another aspect of the present invention, there is provided a MEMS switch comprising: a substrate; a fixing portion formed on the substrate; a movable beam including a lower electrode, a first insulation layer formed on the lower electrode, and an upper electrode formed on the first insulation layer, the movable beam having one end fixed by the fixing portion, the lower electrode and the first insulation layer having an opening going through both of the lower electrode and the first insulation layer; a fixed electrode formed on the substrate facing to a bottom surface of the other end of the movable beam, the fixed electrode facing to the opening; a contact electrode formed in the opening so as to project below the bottom surface of the movable beam and to be electrically connected to the upper electrode as well as to be insulated from the lower electrode; and a second insulation layer formed on a bottom surface of the lower electrode facing to the fixed electrode while avoiding the contact electrode so as to insulate the lower electrode from the fixed electrode and to permit the contact electrode to come into contact with the fixed electrode.

According to another aspect of the present invention, there is provided a MEMS switch comprising: a substrate; a fixing portion formed on the substrate; a conductive movable beam having one end fixed by the fixing portion; a fixed lower electrode formed on the substrate facing to a bottom surface of the other end of the movable beam; a first insulation layer formed on the fixed lower electrode and having an opening for exposing a part of the fixed lower electrode; a fixed upper electrode formed on the first insulation layer; a second insulation layer formed on the fixed upper electrode; and a contact electrode formed in the opening so as to be electrically connected to the fixed lower electrode as well as to be insulated from the fixed upper electrode and to project above an upper surface of the second insulation layer.

According to another aspect of the present invention, there is provided a MEMS switch comprising: a substrate; a fixing portion formed on the substrate; a conductive movable beam having one end fixed by the fixing portion; a fixed lower electrode formed on the substrate facing to a bottom surface of the other end of the movable beam; a first insulation layer formed on the fixed lower electrode and having an opening for exposing a part of the fixed lower electrode; a fixed upper electrode formed on the first insulation layer; a contact electrode formed in the opening so as to be electrically connected to the fixed lower electrode as well as to be insulated from the fixed upper electrode and to project above the upper surface of the fixed upper electrode; and a second insulation layer formed on the bottom surface of the other end of the movable beam and having an opening facing to the contact electrode.

According to another aspect of the present invention, there is provided a MEMS switch comprising: a substrate; a fixing portion formed on the substrate; a movable beam including a lower electrode, a lower piezoelectric layer formed on the lower electrode, an intermediate electrode formed on the lower piezoelectric layer, an upper piezoelectric layer formed on the intermediate electrode, and an upper electrode formed on the upper piezoelectric layer, the movable beam having one end fixed by the fixing portion, the lower electrode and the lower piezoelectric layer having an opening going through both of the lower electrode and the lower piezoelectric layer; a fixed electrode formed on the substrate facing to a bottom surface of the other end of the movable beam, the fixed electrode facing to the opening; a contact electrode formed in the opening so as to project below the bottom surface of the movable beam and to be electrically connected to the intermediate electrode as well as to be insulated from the lower electrode; and an insulation layer formed on the fixed electrode and having an opening facing to the contact electrode so as to insulate the lower electrode from the fixed electrode and to permit the contact electrode to come into contact with the fixed electrode.

According to another aspect of the present invention, there is provided a MEMS switch comprising: a substrate; a fixing portion formed on the substrate; a movable beam including a lower electrode, a lower piezoelectric layer formed on the lower electrode, an intermediate electrode formed on the lower piezoelectric layer, an upper piezoelectric layer formed on the intermediate electrode, and an upper electrode formed on the upper piezoelectric layer, the movable beam having one end fixed by the fixing portion, the lower electrode and the lower piezoelectric layer having an opening going through both of the lower electrode and the lower piezoelectric layer; a fixed electrode formed on the substrate facing to a bottom surface of the other end of the movable beam, the fixed electrode facing to the opening;

a contact electrode formed in the opening so as to project below the bottom surface of the movable beam and to be electrically connected to the intermediate electrode as well as to be insulated from the lower electrode; and an insulation layer formed on a bottom surface of the lower electrode facing to the fixed electrode while avoiding the contact electrode so as to insulate the lower electrode from the fixed electrode and to permit the contact electrode to come into contact with the fixed electrode.

DETAILED DESCRIPTION OF THE EMBODIMENTS

Embodiments of a MEMS switch according to the present invention will be described below in detail with reference to the figures.

Figure 1:
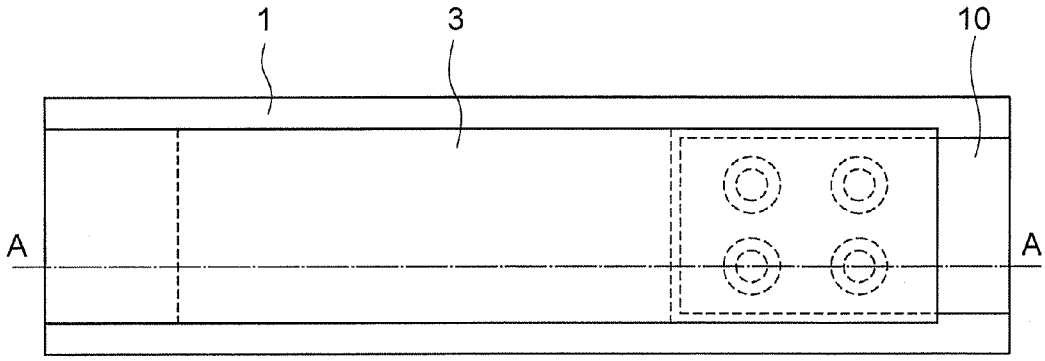
FIG. 1 is a plan view of a first embodiment of the present invention.
Figure 2:
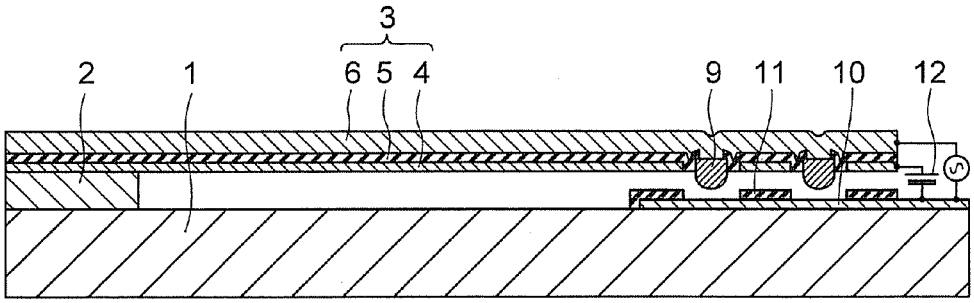
FIG. 2 is a sectional view of the first embodiment of the present invention.

FIG. 1 is a plan view of an electrostatically driven DC contact type MEMS switch according to a first embodiment of the present invention, FIG. 2 is a sectional view taken along the cut line A-A of FIG. 1 of the MEMS switch according to the first embodiment of the present invention.

The MEMS switch according to the first embodiment of the present invention comprises: a substrate 1; a fixing portion 2 formed on the substrate 1; a movable beam 3 including a lower electrode 4, a first insulation layer 5 formed on the lower electrode 4, and an upper electrode 6 formed on the first insulation layer 5, the movable beam 3 having one end fixed by the fixing portion 2, the lower electrode 4 and the first insulation layer 5 having openings going through both of the lower electrode 4 and the first insulation layer 5; a fixed electrode 10 formed on the substrate 1 facing to a bottom surface of the other end of the movable beam 3, the fixed electrode 10 facing to the opening; contact electrodes 9 formed in the openings so as to project below the bottom surface of the movable beam 3 and to be electrically connected to the upper electrode 6 as well as to be insulated from the lower electrode 4; and a second insulation layer 11 formed on the fixed electrode 10 and having openings facing to the contact electrodes 9 so as to insulate the lower electrode 4 from the fixed electrode 10 and to permit the contact electrodes 9 to come into contact with the fixed electrode 10.

One end of the movable beam 3, which includes the lower electrode 4, the first insulation layer 5, and the upper electrode 6, is supported and fixed by the fixing portion 2, and the other one end of the movable beam 3 is arranged as an up/down movable end portion. The contact electrodes 9 are typically formed to the movable end portion.

The movable end portion of the movable beam 3 and the portion on the substrate 1 facing to the movable end portion are specifically arranged as described below as an example.

The fixed electrode 10 is formed on the substrate 1, openings are formed in the second insulation layer 11, which covers the fixed electrode 10, at four positions inwardly of the peripheral portion of the second insulation layer 11, and the surface of the fixed electrode 10 is exposed in the openings.

The fixed electrode 10 and the second insulation layer 11 are formed in a region facing to the bottom surface of the movable end portion of the movable beam 3.

Openings are formed to the lower electrode 4 and the first insulation layer 5 located in the movable end portion of the movable beam 3 in four portions facing to the openings of the second insulation layer 11 at the four positions, that is, in four portions inwardly of the peripheral portions of the lower electrode 4 and the first insulation layer 5.

Four contact electrodes 9 are formed in the four openings of the lower electrode 4 and the first insulation layer 5, respectively so that they project below the bottom surface of the movable beam 3 facing to the fixed electrode 10, that is, below the bottom surface of the lower electrode 4 in this embodiment and are electrically connected to the upper electrode 6 as well as insulated from the lower electrode 4.

A reason why the expression that "project below the bottom surface of the movable beam 3 facing to the fixed electrode 10" is used as to the degree of downward projection of the contact electrodes 9 resides in that the second insulation layer 11 may be formed on the fixed electrode 10 on the substrate 1 side as described later, or may be additionally formed to the bottom surface of the lower electrode 4 on the movable beam 3 side facing to the fixed electrode 10. When the second insulation layer 11 is formed on the fixed electrode 10, the bottom surface of the lower electrode 4 constitutes the bottom surface of the movable beam 3, whereas when the second insulation layer 11 is additionally formed to the bottom surface of the lower electrode 4, the bottom surface of the second insulation layer 11 constitutes at least the bottom surface of the movable end portion of the movable beam 3.

In the first embodiment of the present invention, the second insulation layer 11 is formed on the fixed electrode 10 as described above.

In the MEMS switch according to the first embodiment of the present invention arranged as described above, when an electrostatic drive voltage 12 is applied between the lower electrode 4 of the movable beam 3 and the fixed electrode 10 on the substrate 1 for driving the movable beam 3 electrostatically, an electrostatic attraction force is generated between both the electrodes, and the movable end portion of the movable beam 3 is attracted to the fixed electrode 10.

However, since the lower electrode 4 and the fixed electrode 10 are insulated by the second insulation layer 11, both the electrodes are not short-circuited, and thus the electrostatic attraction force is maintained while the electrostatic drive voltage 12 is applied.

In contrast, the four contact electrodes 9 formed so as to project below the bottom surface of the movable beam 3 facing to the fixed electrode 10, that is, below the bottom surface of the lower electrode 4 come into contact with the fixed electrode 10 exposed in the four openings of the second insulation layer 11, respectively, thereby the fixed electrode 10 is electrically conducted to the upper electrode 6 of the movable beam 3.

The respective contact electrodes 9 are surrounded by the fixed electrode 10 and the lower electrode 4 of the movable beam 3 which generate the electrostatic attraction force.

Accordingly, even if the movable beam 3 is formed of a deposited thin-film and is less rigid, the respective contact electrodes 9 are pressed against the fixed electrode 10 with uniform and sufficiently strong force.

As a result, according to the first embodiment of the present invention, there can be realized an electrostatically driven DC contact type MEMS switch having a low contact resistance between the contact electrodes 9 and the fixed electrode 10, a long durable life, and high reliability.

Next, an example of manufacturing steps of the electrostatically driven DC contact type MEMS switch according to the first embodiment of the present invention will be described.

FIGS. 3A to 3E are sectional views showing structures of the electrostatically driven DC contact type MEMS switch according to the first embodiment of the present invention at respective manufacturing steps. The respective sectional views of FIGS. 3A to 3E are sectional views of portions corresponding to a section taken along a line A-A of FIG. 1.

Figure 3A:
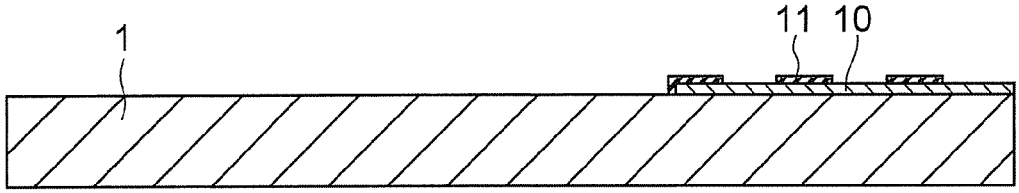
FIGS. 3A to 3E are sectional views of manufacturing steps of the first embodiment of the present invention.

First, as shown in FIG. 3A, a fixed electrode 10 composed of 300 nm thick iridium (Ir) is formed on a glass substrate 1 using sputtering method and lift-off method. Further, an insulation layer 11 (the second insulation layer 11) composed of 200 nm silicon oxide is formed using reactive sputtering method, and openings are formed in four portions inwardly of the peripheral portion of the insulation layer 11 by carrying out patterning by lithography method and RIE, thereby the surface of the fixed electrode 10 is exposed.

Precious metals such as gold (Au), platinum (Pt), and the like may be used as the material of the fixed electrode 10, in addition to iridium (Ir).

Various types of an insulation film composed of silicon nitride, aluminum oxide, and the like used in ordinary semiconductor process may be used as the material of the insulation layer 11, in addition to silicon oxide.

Figure 3B:
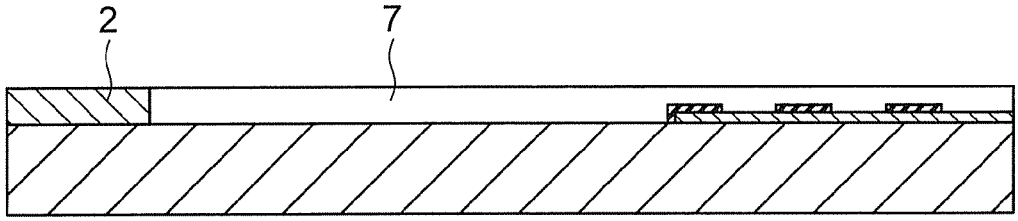

After the fixed electrode 10 and the insulation layer 11 are formed, a silicon nitride film is formed by MOCVD method, and patterning is carried out by lithography method and RIE, thereby a fixing portion 2 is formed as shown in FIG. 3B. Further, a sacrificial layer 7 composed of amorphous silicon is formed by sputtering method, and surface polishing and flattening are carried out by CMP (chemical-mechanical polishing) until the top surface of the fixing portion 2 is exposed.

Although it is possible to use inorganic materials, metal materials, organic materials, and the like, which can selectively be etched in relation to other film materials, as the sacrificial layer 7, amorphous silicon is used in this embodiment.

Figure 3C:
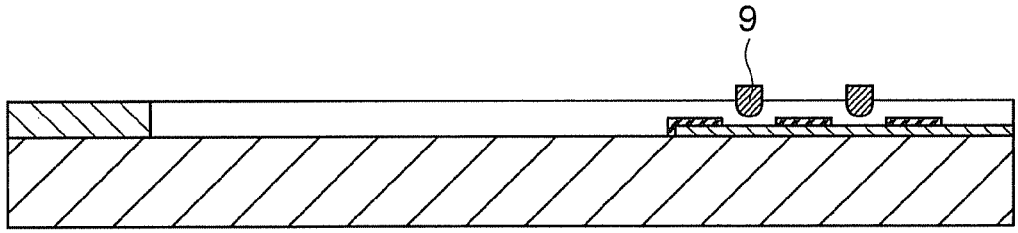

After the fixing portion 2 and the sacrificial layer 7 are formed, a 400 nm deep trench is formed in the sacrificial layer 7 by subjecting it to light etching by RIE using a lift off resist pattern, and subsequently gold (Au) is deposited by sputtering method and is patterned by lift off method, thereby contact electrodes 9 are formed as shown in FIG. 3C.

Figure 3D:
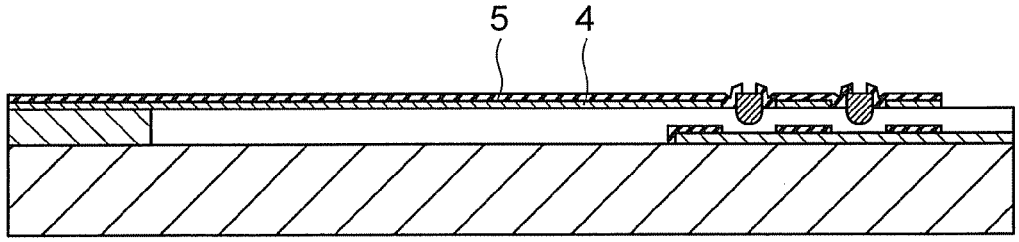

After the contact electrodes 9 are formed, a lower electrode 4 composed of 300 nm thick aluminum (Al) and an insulation layer 5 (the first insulation layer 5) composed of 200 nm thick silicon oxide are sequentially formed by sputtering method, lithography method, and RIE as shown in FIG. 3D. At the time, the lower electrode 4 is patterned so that it is separated from a contact electrodes 9 and does not directly come into contact with it, and the insulation layer 5 is patterned to expose the upper surfaces of the contact electrodes 9 after it is formed to bury the gaps between the lower electrode 4 and the contact electrodes 9.

Figure 3E:
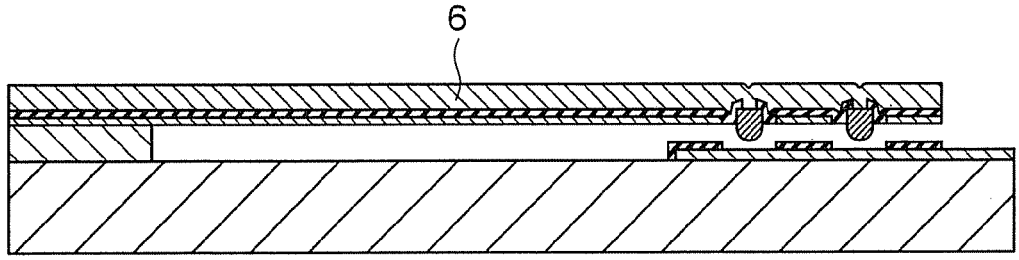

After the lower electrode 4 and the insulation layer 5 are formed, an upper electrode 6 composed of 1 μm thick aluminum (Al) is formed to come into electrical contact with the contact electrodes 9 by sputtering method, lithography method, and RIE as shown in FIG. 3E. Thereafter, when the sacrificial layer 7 is removed by selective etching using xenon difluoride ($XeF_2$), the electrostatically driven DC contact type MEMS switch according to the first embodiment of the present invention having the structure shown in FIGS. 1 and 2 is completed.

In the MEMS switch according to the first embodiment of the present invention, when the resistance between the upper electrode 6 of the movable beam 3 and the fixed electrode 10 is measured by applying the electrostatic drive voltage 12 from 0V to 15V between the lower electrode 4 of the movable beam 3 and the fixed electrode 10, a very low contact resistance of 1Ω or less can be obtained even if open/close operation is carried out $10^8$ times or more.

Figure 4:
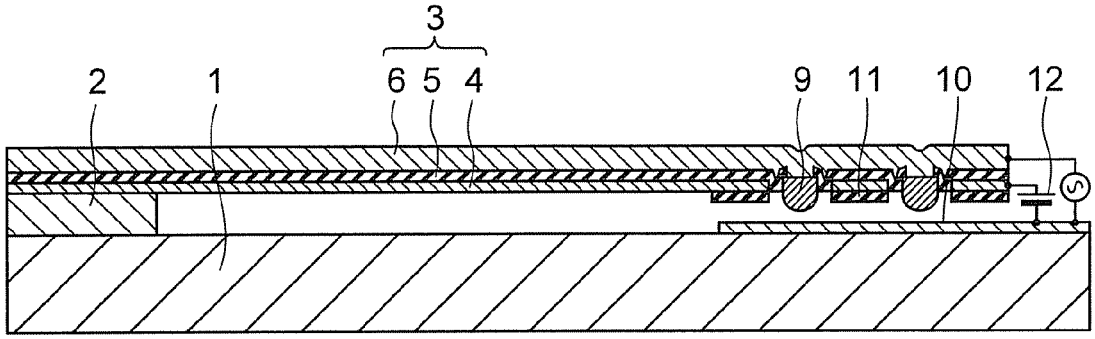
FIG. 4 is a sectional view of a modification of the first embodiment of the present invention.

FIG. 4 is a sectional view of a modification of the electrostatically driven DC contact type MEMS switch according to the first embodiment of the present invention and shows a portion corresponding the section taken along the line A-A of FIG. 1.

In the modification of the first embodiment shown in FIG. 4, the second insulation layer 11, which is formed on the fixed electrode 10 on the substrate 1 side in the first embodiment shown in FIG. 1, is additionally formed on the bottom surface of the lower electrode 4 on the movable beam 3 side facing to the substrate 1.

That is, the second insulation layer 11 in the modification of the first embodiment shown in FIG. 4 is formed on the bottom surface of the lower electrode 4 facing to the fixed electrode 10 in the vicinities of the contact electrodes 9 avoiding the contact electrodes 9 so that contact electrodes 9 can come into contact with the fixed electrode 10 while insulating the lower electrode 4 from the fixed electrode 10.

Although the second insulation layer 11 is formed on a different portion, it has exactly the same role in that it prevents short circuit between the lower electrode 4 and fixed electrode 10 when the electrostatic drive voltage 12 is applied between the lower electrode 4 and fixed electrode 10.

There can be realized an electrostatically driven DC contact type MEMS switch having a low contact resistance between the contact electrodes 9 and the fixed electrode 10, a long durable life, and high reliability also in the modification likewise the first embodiment.

Figure 5:
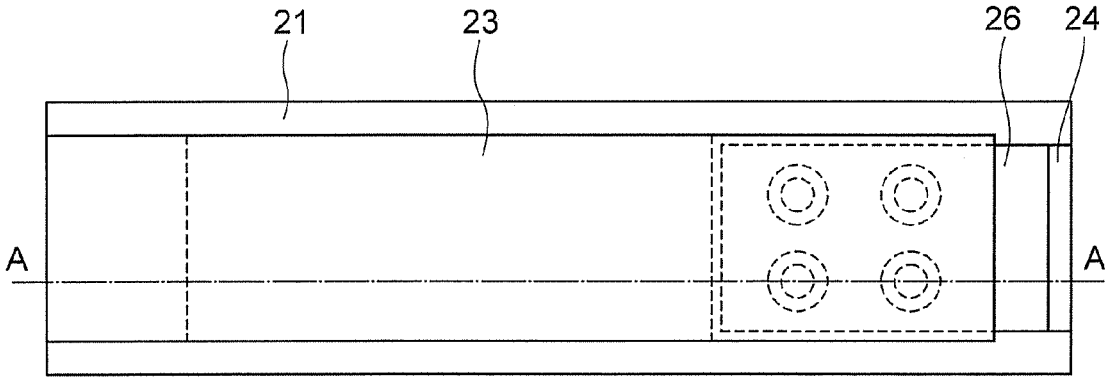
FIG. 5 is a plan view of a second embodiment of present invention.
Figure 6:
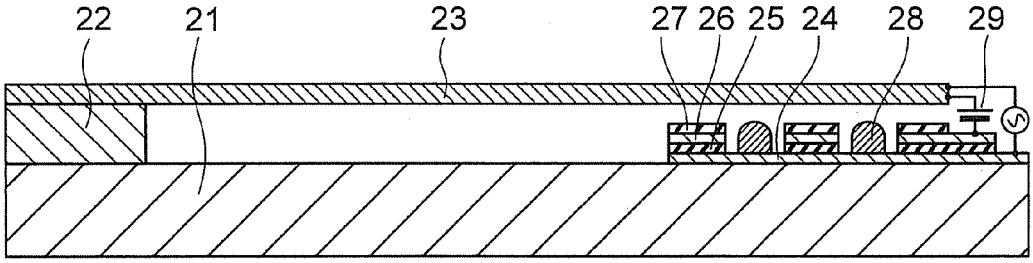
FIG. 6 is a sectional view of the second embodiment of the present invention.

FIG. 5 is a plan view of an electrostatically driven DC contact type MEMS switch according to a second embodiment of the present invention, and FIG. 6 is a sectional view of the MEMS switch according to the second embodiment of the present invention taken along a line A-A of FIG. 5.

The MEMS switch according to the second embodiment of the present invention comprises: a substrate 21; a fixing portion 22 formed on the substrate 21; a conductive movable beam 23 having one end fixed by the fixing portion 22; a fixed lower electrode 24 formed on the substrate 21 facing to a bottom surface of the other end of the movable beam 23; a first insulation layer 25 formed on the fixed lower electrode 24 and having openings for exposing parts of the fixed lower electrode 24; a fixed upper electrode 26 formed on the first insulation layer 25; a second insulation layer 27 formed on the fixed upper electrode 26; and contact electrodes 28 formed in the openings so as to be electrically connected to the fixed lower electrode 24 as well as to be insulated from the fixed upper electrode 26 and to project above an upper surface of the second insulation layer 27.

In the MEMS switch according to the second embodiment of the present invention, all of the fixed upper electrode 26 to which an electrostatic drive voltage 29 is applied for driving the movable beam 23 electrostatically, the fixed lower electrode 24 through which a high frequency signal passes, the contact electrodes 28 for electrically conducting the movable beam 23 and the fixed lower electrode 24, and the like are formed on the substrate 21, and the movable beam 23 has a one-layer structure.

The movable beam 23 formed of a conductive material is fixed on the substrate 21 with the one end of the movable beam 23 supported by the fixing portion 22, and the other one end of the movable beam 23, that is, the movable end portion of the movable beam 23 extends above the contact electrodes 28 and the fixed upper electrode 26.

The first insulation layer 25, the fixed upper electrode 26, and the second insulation layer 27 has openings formed at four positions, for example, inwardly of the periphery of the first insulation layer 25, the fixed upper electrode 26, and the second insulation layer 27. Four contact electrodes 28 are formed in the openings, respectively so that they are electrically connected to the fixed lower electrode 24 as well as insulated from the fixed upper electrode 26 and project above the upper surface of the second insulation layer 27.

When the electrostatic drive voltage 29 is applied between the movable beam 23 and the upper electrode 26 for driving the movable beam 23 electrostatically, an electrostatic attraction force is generated between the movable beam 23 and the upper electrode 26, thereby the movable end portion of the movable beam 23 is attracted to the fixed electrode 26.

However, since the movable beam 23 is insulated from the upper fixed electrode 26 by the second insulation layer 27, both the electrodes are not short-circuited, and the electrostatic attraction force is maintained while the electrostatic drive voltage 29 is applied.

In contrast, the four contact electrodes 28 formed so as to project above the upper surface of the second insulation layer 27 come into contact with the movable end portion of the movable beam 23, respectively, thereby the movable beam 23 is electrically conducted to the fixed lower electrode 24.

At the time, the respective contact electrodes 28 are surrounded by the fixed upper electrode 26 and the movable end portion of the movable beam 23, which generate the electrostatic attraction force.

Accordingly, even if the movable beam 23 is formed of a deposited thin-film and is less rigid, the movable end portion of the movable beam 23 is pressed against respective contact electrodes 28 with uniform and sufficiently strong force.

As a result, according to the second embodiment of the present invention, there can be realized an electrostatically driven DC contact type MEMS switch having a low contact resistance between the contact electrode 28 and the conductive movable beam 23, a long durable life, and high reliability.

Note that, in the second embodiment of the present invention, the second insulation layer 27 is formed on the fixed upper electrode 26 as described above.

However, it is possible to construct a modification arranged such that the second insulation layer 27 is additionally formed on the bottom surface of the movable beam 23 facing to the fixed upper electrode 26 in place of that it is formed on the fixed upper electrode 26 on the substrate 21 side also in the second embodiment of the present invention.

In this case, the modification of the MEMS switch according to the second embodiment of the present invention comprises: a substrate 21; a fixing portion 22 formed on the substrate 21; a conductive movable beam 23 having one end fixed by the fixing portion 22; a fixed lower electrode 24 formed on the substrate 21 facing to a bottom surface of the other end of the movable beam 23; a first insulation layer 25 formed on the fixed lower electrode 24 and having openings for exposing parts of the fixed lower electrode 24; a fixed upper electrode 26 formed on the first insulation layer 25; contact electrodes 28 formed in the openings so as to be electrically connected to the fixed lower electrode 24 as well as to be insulated from the fixed upper electrode 26 and to project above the upper surface of the fixed upper electrode 26; and a second insulation layer 27 formed on the bottom surface of the other end of the movable beam 23 and having openings facing to the contact electrodes 28.

Figure 7:
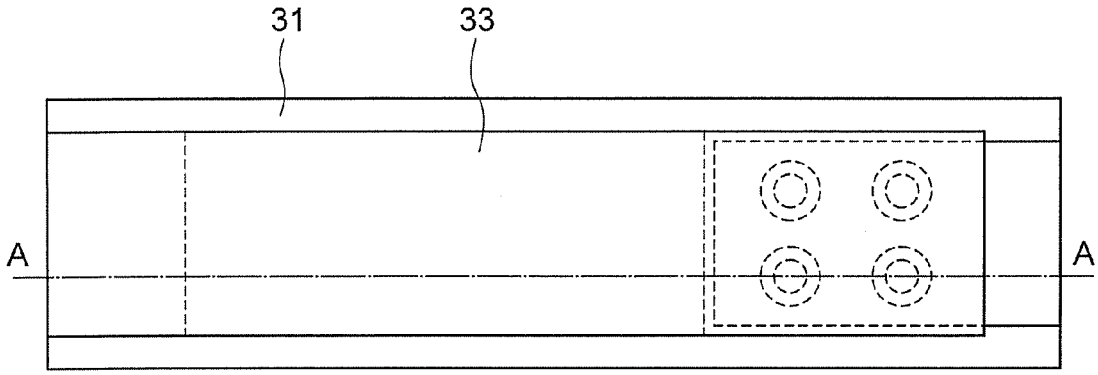
FIG. 7 is a plan view of a third embodiment of the present invention.
Figure 8:
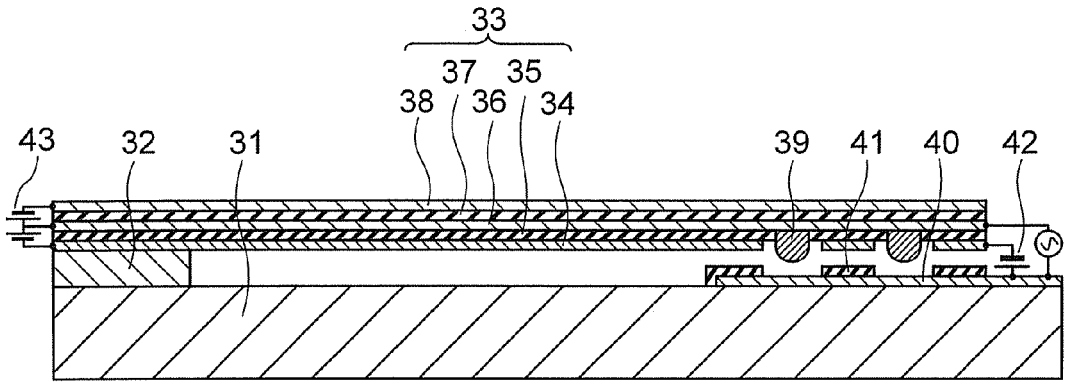
FIG. 8 is a sectional view of the third embodiment of the present invention.

FIG. 7 is a plan view of an electrostatically driven DC contact type MEMS switch according to a third embodiment of the present invention, and FIG. 8 is a sectional view of the MEMS switch according to the third embodiment of the present invention taken along a line A-A of FIG. 7.

The MEMS switch according to the third embodiment of the present invention comprises: a substrate 31; a fixing portion 32 formed on the substrate 31; a movable beam 33 including a lower electrode 34, a lower piezoelectric layer 35 formed on the lower electrode 34, an intermediate electrode 36 formed on the lower piezoelectric layer 35, an upper piezoelectric layer 37 formed on the intermediate electrode 36, and an upper electrode 38 formed on the upper piezoelectric layer 37, the movable beam 33 having one end fixed by the fixing portion 32, the lower electrode 34 and the lower piezoelectric layer 35 having openings going through both of the lower electrode 34 and the lower piezoelectric layer 35; a fixed electrode 40 formed on the substrate 31 facing to a bottom surface of the other end of the movable beam 33, the fixed electrode 40 facing to the openings; contact electrodes 39 formed in the openings so as to project below the bottom surface of the movable beam 33 and to be electrically connected to the intermediate electrode 36 as well as to be insulated from the lower electrode 34; and an insulation layer 41 formed on the fixed electrode 40 and having openings facing to the contact electrodes 39 so as to insulate the lower electrode 34 from the fixed electrode 40 and to permit the contact electrodes 39 to come into contact with the fixed electrode 40.

The MEMS switch according to the third embodiment of the present invention has a hybrid type drive mechanism that also acts as a piezoelectric bimorph drive mechanism in addition to an electrostatic drive mechanism similar to that of the first and second embodiments.

The one end of the movable beam 33 including the lower electrode 34, the lower piezoelectric layer 35, the intermediate electrode 36, the upper piezoelectric layer 37, and the upper electrode 38 is supported and fixed by the fixing portion 32, and the other one end of the movable beam 33 is arranged as an up/down movable end portion. The contact electrodes 39 are typically formed to the movable end portion.

The movable end portion of the movable beam 33 and the portion on the substrate 31 facing to the movable end portion are specifically arranged as described below as an example.

The fixed electrode 40 is formed on the substrate 31, openings are formed in the insulation layer 41, which covers the fixed electrode 40, at four positions inwardly of the peripheral portion of the insulation layer 41, and the surface of the fixed electrode 40 is exposed in the openings.

The fixed electrode 40 and the insulation layer 41 are formed in a region facing to the movable end portion of the movable beam 33.

Openings are formed in the lower electrode 34 and the lower piezoelectric layer 35 in the movable end portion of the movable beam 33 in four portions facing to the openings of the insulation layer 41 at the four positions, that is, in four portions inwardly of the peripheral portions of the lower electrode 34 and the first insulation layer 35.

Four contact electrodes 39 are formed in the four openings of the lower electrode 34 and the lower piezoelectric layer 35 such that they project below the bottom surface of the movable beam 33 facing to the fixed electrode 40, that is, in the embodiment, below the bottom surface of the lower electrode 34 and are electrically connected to the intermediate electrode 36 as well as insulated from the lower electrode 34.

A reason why the expression that "project below the bottom surface of the movable beam 33 facing to the substrate 31" is used as to the degree of downward projection of the contact electrodes 39 resides in that the insulation layer 41 may be formed on the fixed electrode 40 on the substrate 31 side as described later, or may be additionally formed on the bottom surface of the lower electrode 34 on the movable beam 33 side facing to the fixed electrode 40. When the insulation layer 41 is formed on the fixed electrode 40, the bottom surface of the lower electrode 34 constitutes the bottom surface of the movable beam 33, whereas when the insulation layer 41 is additionally formed on the bottom surface of the lower electrode 34, the bottom surface of the insulation layer 41 constitutes at least the bottom surface of the movable end portion of the movable beam 33.

In the third embodiment of the present invention, the insulation layer 41 is formed on the fixed electrode 40 as described above.

The lower piezoelectric layer 35 and the upper piezoelectric layer 37 of the movable beam 33 are polarized in the same direction vertical to a layer surface. Since the lower piezoelectric layer 35 is contracted in the layer surface and the upper piezoelectric layer 37 is expanded in the layer surface by applying reverse bias piezoelectric drive voltages 43 between the lower electrode 34 and the intermediate electrode 36 and between the intermediate electrode 36 and the upper electrode 38, thereby the movable beam 33 is flexed in an upward convex state and the movable end portion comes into contact with the substrate 31. The drive voltages 43 applied between the lower electrode 34 and the intermediate electrode 36 is inverse with the drive voltages 43 applied between the intermediate electrode 36 and the upper electrode 38. Note that, in this embodiment, a 0.5 μm thick aluminum nitride (AlN) piezoelectric film formed by sputtering method and subjected to c-axis orientation in a thickness direction is used as the lower piezoelectric layer 35 and the upper piezoelectric layer 37.

On the other hand, when an electrostatic drive voltage 42 is also applied between the lower electrode 34 of the movable beam 33 and the fixed electrode 40 for driving the movable beam 33 electrostatically, electrostatic attraction force is generated between the lower electrode 34 and the fixed electrode 40, and the movable end portion of the movable beam 33 is attracted to the fixed electrode 40.

However, since the insulation layer 41 is formed on the fixed electrode 40, the electrostatic attraction force is maintained without short-circuiting the lower electrode 34 of the movable beam 33 and the fixed electrode 40. Accordingly, the contact electrodes 39 of the movable beam 33 come into contact with the fixed electrode 40, and the intermediate electrode 36 of the movable beam 33 is electrically conducted to the fixed electrode 40 through the contact electrodes 39.

The respective contact electrodes 39 are surrounded by the fixed electrode 40 and the lower electrode 34 of the movable beam 33 which generate the electrostatic attraction force.

Accordingly, even if the movable beam 33 is formed of a deposited thin-film and is less rigid, the respective contact electrodes 39 are pressed against the fixed electrode 40 with uniform and sufficiently strong force.

Note that the lower electrode 34 of the movable beam 33 achieves a double role as a piezoelectric bimorph drive electrode and an electrostatic drive electrode, and further the intermediate electrode 36 achieves a double role as the piezoelectric bimorph drive electrode and a high frequency signal electrode.

Although the piezoelectric bimorph drive has a feature in that it can obtain a large amount of deformation with a low voltage, the press force of the movable end portion of the movable beam 33 is weak. On the other hand, in the electrostatic drive, since the electrostatic attraction force is proportional to the minus second power of the distance between electrodes, a large drive voltage is necessary when the distance therebetween is long. However, the electrostatic drive exerts a large amount of attraction force when two electrodes come into contact with each other through an insulation layer.

Accordingly, the hybrid type drive mechanism having both the piezoelectric drive and the electrostatic drive as in this embodiment is advantageous in that while the lower electrode 34 of the movable beam 33 and the fixed electrode 40 are separated from each other, the movable end portion of the movable beam 33 is mainly deformed by the piezoelectric drive, and when the movable end portion of the movable beam 33 approaches the fixed electrode 40, a large amount of attraction force can be obtained by the electrostatic drive.

As a result, according to the third embodiment of the present invention, there can be realized an electrostatically driven DC contact type MEMS switch having a low drive voltage, a low contact resistance between the contact electrode 39 and the fixed electrode 40, long durable life, and high reliability.

Specifically, in the MEMS switch according to the first embodiment driven only by the electrostatic drive, a drive voltage of 15V is necessary as described above. However, in the MEMS switch according to the third embodiment in which the length of the movable beam 33 is set to 400 μm, and the gap between the contact electrodes 39 and the fixed electrode 40 is set to 2 μm, 6V is sufficient as an operation voltage of the hybrid drive composed of the electrostatic drive and the piezoelectric drive.

Note that, in the third embodiment of the present invention, the insulation layer 41 is formed on the fixed electrode 40 as described above.

However, in the third embodiment of the present invention, it is also possible to construct a first modification arranged such that the insulation layer 41 is additionally formed on the bottom surface of the lower electrode 34 on the movable beam 33 side facing to the fixed electrode 40 in place of that the insulation layer 41 is formed on the fixed electrode 40 on the substrate 31 side.

In this case, the first modification of the MEMS switch according to the third embodiment of the present invention comprises: a substrate 31; a fixing portion 32 formed on the substrate 31; a movable beam 33 including a lower electrode 34, a lower piezoelectric layer 35 formed on the lower electrode 34, an intermediate electrode 36 formed on the lower piezoelectric layer 35, an upper piezoelectric layer 37 formed on the intermediate electrode 36, and an upper electrode 38 formed on the upper piezoelectric layer 37, the movable beam 33 having one end fixed by the fixing portion 32, the lower electrode 34 and the lower piezoelectric layer 35 having openings going through both of the lower electrode 34 and the lower piezoelectric layer 35; a fixed electrode 40 formed on the substrate 31 facing to a bottom surface of the other end of the movable beam 33, the fixed electrode 40 facing to the openings; contact electrodes 39 formed in the openings so as to project below the bottom surface of the movable beam 33 and to be electrically connected to the intermediate electrode 36 as well as to be insulated from the lower electrode 34; and an insulation layer 41 formed on a bottom surface of the lower electrode 34 facing to the fixed electrode 40 while avoiding the contact electrodes 39 so as to insulate the lower electrode 34 from the fixed electrode 40 and to permit the contact electrodes 39 to come into contact with the fixed electrode 40.

Figure 9:
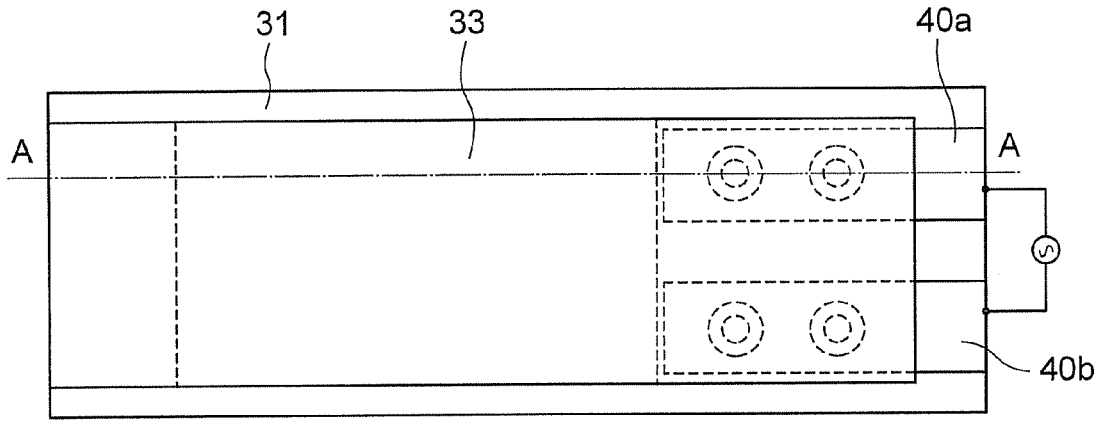
FIG. 9 is a plan view of a second modification of the third embodiment of the present invention.
Figure 10:
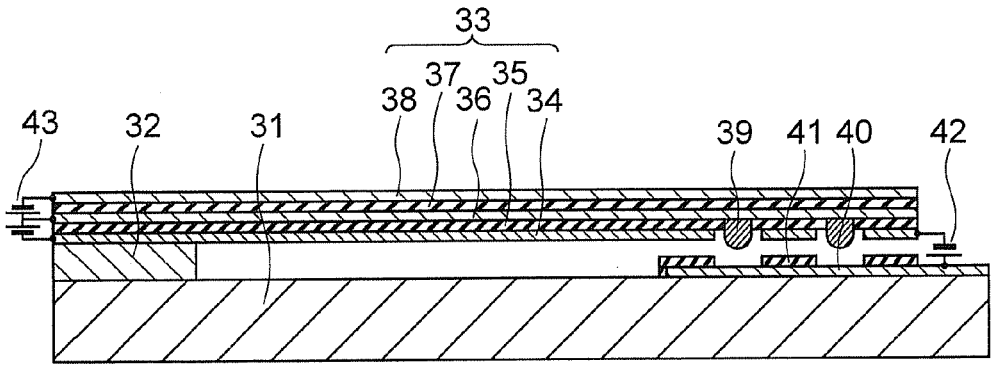
FIG. 10 is a sectional view of the second modification of the third embodiment of the present invention.

FIG. 9 is a plan view of a second modification of the electrostatically driven DC contact type MEMS switch according to the third embodiment of the present invention, and FIG. 10 is a sectional view of the MEMS switch according to the third embodiment of the present invention taken along a line A-A of FIG. 9.

The overall arrangement of the second modification of the third embodiment of the present invention is approximately the same as the third embodiment except that a fixed electrode 40 on a substrate 31 is formed by being divided into a first fixed electrode 40*a* and a second fixed electrode 40*b* along a direction vertical to a lengthwise direction of a movable beam 33 and that contact electrodes 39 are formed at positions facing to the first fixed electrode 40*a* and the second fixed electrode 40*b*, respectively.

That is, the first fixed electrode 40*a* and the second fixed electrode 40*b* in the second modification of the third embodiment of the present invention are formed by being divided along the direction vertical to the longitudinal direction of the movable beam 33 across divided regions along the longitudinal direction of the movable beam 33.

As apparent from the above arrangement, the second modification of the third embodiment of the present invention is an example a so-called series type switch.

In the second modification, when the switch is closed by that the movable beam 33 comes into contact with the substrate 31, a high frequency signal can flow along a path from the fixed electrode 40*a* to the fixed electrode 40*b* through contact electrodes 39, an intermediate electrode 36, and contact electrodes 39. Accordingly, since the distance in which the high frequency signal flows in the intermediate electrode 36 of the movable beam 33 can be greatly shortened, it is possible to reduce a series resistance component.

It is possible to construct a further modification arranged such that the insulation layer 41 is additionally formed on the bottom surface of the lower electrode 34 on the movable beam 33 side facing to the fixed electrode 40 in place of that the insulation layer 41 is formed on the fixed electrode 40 on the substrate 31 side also in the second modification of the third embodiment of the present invention.

What is claimed is:

1. A MEMS switch comprising:

a substrate;

a fixing portion formed on the substrate;

a movable beam including a lower electrode, a lower piezoelectric layer formed on the lower electrode, an intermediate electrode formed on the lower piezoelectric layer, an upper piezoelectric layer formed on the intermediate electrode, and an upper electrode formed on the upper piezoelectric layer, the movable beam having one end fixed by the fixing portion, the lower electrode and the lower piezoelectric layer having an opening that goes through both of the lower electrode and the lower piezoelectric layer and reaches a bottom surface of the intermediate electrode, the opening being surrounded by the lower electrode;

a fixed electrode formed on the substrate facing to a bottom surface of the other end of the movable beam, the fixed electrode facing to the opening;

a contact electrode formed in the opening so as to project below the bottom surface of the movable beam and to be electrically connected to the intermediate electrode as well as to be insulated from the lower electrode; and an insulation layer formed on the fixed electrode and having an opening facing to the contact electrode so as to insulate the lower electrode from the fixed electrode and to permit the contact electrode to come into contact with the fixed electrode;

wherein the fixed electrode is formed by being divided into a first fixed electrode and a second fixed electrode along a direction vertical to a lengthwise direction of the movable beam, and the contact electrodes are formed at positions facing to the first fixed electrode and the second fixed electrode, respectively.

2. The MEMS switch according to claim 1, wherein the opening is formed inwardly of a peripheral portion of the lower piezoelectric layer.

3. The MEMS switch according to claim 1, wherein a bottom surface of the lower electrode constitutes the bottom surface of the other end of the movable beam.

4. The MEMS switch according to claim 1, wherein a predetermined voltage is applied between the lower electrode and the fixed electrode for driving the movable beam electrostatically.

5. The MEMS switch according to claim 4, wherein when the predetermined voltage is applied, the contact electrode is surrounded by the lower electrode and the fixed electrode.

6. The MEMS switch according to claim 1, wherein the lower piezoelectric layer and the upper piezoelectric layer are polarized in the same direction vertical to a layer surface.

7. The MEMS switch according to claim 6, wherein a drive voltage applied between the lower electrode and the intermediate electrode is inverse with a drive voltage applied between the intermediate electrode and the upper electrode.

8. A MEMS switch comprising:

a substrate;

a fixing portion formed on the substrate;

a movable beam including a lower electrode, a lower piezoelectric layer formed on the lower electrode, an intermediate electrode formed on the lower piezoelectric layer, an upper piezoelectric layer formed on the intermediate electrode, and an upper electrode formed on the upper piezoelectric layer, the movable beam having one end fixed by the fixing portion, the lower electrode and the lower piezoelectric layer having an opening that goes through both of the lower electrode and the lower piezoelectric layer and reaches a bottom surface of the intermediate electrode, the opening being surrounded by the lower electrode;

a fixed electrode formed on the substrate facing to a bottom surface of the other end of the movable beam, the fixed electrode facing to the opening;

a contact electrode formed in the opening so as to project below the bottom surface of the movable beam and to be electrically connected to the intermediate electrode as well as to be insulated from the lower electrode; and an insulation layer formed on a bottom surface of the lower electrode facing to the fixed electrode while avoiding the contact electrode so as to insulate the lower electrode from the fixed electrode and to permit the contact electrode to come into contact with the fixed electrode;

wherein the fixed electrode is formed by being divided into a first fixed electrode and a second fixed electrode along a direction vertical to a lengthwise direction of the movable beam, and the contact electrodes are formed at positions facing to the first fixed electrode and the second fixed electrode, respectively.

9. The MEMS switch according to claim 8, wherein the opening is formed inwardly of a peripheral portion of the lower piezoelectric layer.

10. The MEMS switch according to claim 8, wherein a bottom surface of the insulation layer constitutes the bottom surface of the other end of the movable beam.

11. The MEMS switch according to claim 8, wherein a predetermined voltage is applied between the lower electrode and the fixed electrode for driving the movable beam electrostatically.

12. The MEMS switch according to claim 11, wherein when the predetermined voltage is applied, the contact electrode is surrounded by the lower electrode and the fixed electrode.

13. The MEMS switch according to claim 8, wherein the lower piezoelectric layer and the upper piezoelectric layer are polarized in the same direction vertical to a layer surface.

14. The MEMS switch according to claim 13, wherein a drive voltage applied between the lower electrode and the intermediate electrode is inverse with a drive voltage applied between the intermediate electrode and the upper electrode.

* * * * *